United States Patent [19]

Yatsuhashi et al.

[11] Patent Number: 4,842,053

[45] Date of Patent: Jun. 27, 1989

[54] HEAT EXCHANGER USING HEAT PIPES

[75] Inventors: Motoharu Yatsuhashi, Funabashi; Masataka Mochizuki, Nagareyama; Shinich Sugihara, Tokyo, all of Japan

[73] Assignees: Fujikura Ltd.; Doryokuro Kakunenryo Kaihatsu Jigyodan, both of Tokyo, Japan

[21] Appl. No.: 116,685

[22] Filed: Nov. 4, 1987

[30] Foreign Application Priority Data

Nov. 13, 1986 [JP] Japan ..... 61-270222

[51] Int. Cl.[4] ..... F28D 15/02

[52] U.S. Cl. ..... 165/104.14; 165/104.26; 165/70

[58] Field of Search ..... 165/104.21, 104.14, 165/104.26, 70

[56] References Cited

U.S. PATENT DOCUMENTS

| | | | |
|---|---|---|---|
| 1,690,108 | 11/1928 | Grady | 165/104.21 |
| 3,677,329 | 7/1972 | Kirkpatrick . | |
| 4,285,394 | 8/1981 | Stewart | 165/104.21 |
| 4,320,246 | 3/1982 | Russell | 165/104.26 |
| 4,444,157 | 4/1984 | Wortey | 165/104.21 |
| 4,560,533 | 12/1985 | Huebotter et al. | 165/70 |
| 4,566,527 | 1/1986 | Pell et al. | 165/104.26 |

FOREIGN PATENT DOCUMENTS

| | | |
|---|---|---|
| 2616284 | 11/1977 | Fed. Rep. of Germany . |
| 602833 | 1/1926 | France . |
| 2185046 | 12/1973 | France . |

*Primary Examiner*—Albert W. Davis, Jr.
*Attorney, Agent, or Firm*—Oblon, Fisher, Spivak, McClelland & Maier

[57] ABSTRACT

Herein disclosed is a heat pipe type heat exchanger which comprises: a container for containing a first heating medium therein or causing the same to flow therethrough; at least one heat pipe extending liquid-tight with a substantially horizontal axis through the container; and a tube extending gas-tight and axially through the heat pipe for causing a second heating medium to flow therethrough, whereby the heat exchange is effected between the first and second heating mediums through the walls of the heat pipe and the tube. In case a plurality of heat pipes are provided, the individual tubes extending axially through the corresponding heat pipes are connected at their ends to each other by means of bends such that they make a zigzag or meandering piping. This retains a wide heat exchanging area. Since the first and second heating mediums to have their heats exchanged with each other are isolated from each other by the heat pipes and the tubes, they are kept away from directly contacting or mixing with each other even if pin holes are formed in either the heat pipes or the tubes. This structure is effective for the heat exchanger between metallic sodium and water. Since the heat pipes are positioned horizontally, moreover, the working fluid can be distributed automatically and sufficiently to the portions receiving heat from the outside so that it can be evaporated to a satisfactory extent.

2 Claims, 3 Drawing Sheets

HEAT EXCHANGER USING HEAT PIPES

BACKGROUND OF THE INVENTION

1. Field of the Invention

The present invention relates to a heat exchanger for exchanging heat between fluids at higher and lower temperatures through heat pipes and, more particularly, to a heat exchanger which is effective in case the heat exchange is accomplished between the cooling medium of liquid metal and water of a nuclear reactor.

2. Description of the Prior Art

As is well known in the relevant art, the heat pipes transfer heat as the latent heat of a working fluid by sealing up closed tubes with a condensable fluid as the working fluid, after the tubes have been evacuated, and by circulating the working fluid within the closed tubes through evaporations and condensations. Since the heat pipes have excellent thermal conductivity, therefore, an efficient heat exchange can be performed if the heat pipes are used in a heat exchanger for the heat exchange between two kinds of fluids that are kept from any contact and mixing.

FIG. 6 is a schematic diagram showing one example of the heat exchanger of the prior art. This heat exchanger is constructed by inserting a plurality of heat pipes 3 into and arranging them across higher- and lower-temperature chambers 1 and 2 isolated from each other. If a hotter fluid 4 is supplied to the higher-temperature chamber 1 whereas a colder fluid 5 is supplied to the lower-temperature chamber 2, the working fluid in the heat pipes 3 evaporates at the higher-temperature ends of the heat pipes 3 so that its resultant steam flows to the lower-temperature ends of the heat pipes 3, where the working fluid radiates its heat and condenses. Thus, the heat is exchanged between the hotter and colder fluids 4 and 5.

Since the passages for these hotter and colder fluids 4 and 5 are thus isolated from each other, the heat exchanger shown in FIG. 6 is effective for the heat exchange between such substances (e.g., liquid sodium and water) as will produce an intense reaction. Since, however, these endothermic and exothermic portions for the heat pipes are isolated, the heat exchanger of FIG. 6 is defective in its large size. Since, moreover, the heat pipes 3 are made of tubes which are thinned to reduce their total thermal resistance and to have an excellent thermal conductivity, it has been found difficult in the heat exchanger shown in FIG. 6 to weld the heat pipes 3 in a sealed state to the chambers 1 and 2, respectively, and to have their welded portions positioned in the opposed walls of the individual chambers 1 and 2. This has been accompanied by a problem that the heat pipes 3 and the individual chambers 1 and 2 have been remarkably difficult to weld or seal up.

In case, on the other hand, the fluid passages can be freely set, the prior art has used a shell tube type heat exchanger which can be small-sized. FIG. 7 is a schematic diagram showing one example of the shell tube type heat exchanger. This heat exchanger is constructed such that a meandering tube 11 for the colder fluid 5 is arranged in a closed shell 10 for the hotter fluid 4 so that the heat exchange may be effected between the hotter and colder fluids 4 and 5 through the wall of the meandering tube 11.

This shell tube type heat exchanger of the prior art shown in FIG. 7 can be small-sized without any reduction in the heat transfer area. Since, however, what exists between the hotter and colder fluids 4 and 5 is the wall of the meandering tube 11, the hotter and colder fluids 4 and 5 will directly contact or mix with each other if the meandering tube 11 turns slightly defective with pin holes or the like. This makes it impossible to use the shell tube type heat exchanger of FIG. 7 for heat exchange between intensely reactive substances such as sodium and water, which are used as the cooling mediums of the nuclear reactor.

Another heat exchanger using heat pipes for exchanging heat between the primary and secondary cooling mediums of nuclear reactor (i.e., sodium and water) is disclosed in the magazine "THE ENERGY DAILY", which was published on Mar. 19, 1986 in the United States. As shown in FIGS. 8 and 9, a heat pipe 13 using mercury as a working fluid 12 has its inside partitioned into a plurality of compartments by baffle plates 15 having fluid vents 14. The heat pipe 13 thus constructed is dipped upright in sodium 16 used as a cooling medium of a nuclear reactor, and a U-shaped cooling water tube 17 is inserted downward into the heat pipe 13. As a result, the working fluid 12 evaporates on the inner wall face of the heat pipe 13 and comes into contact with the outer circumference of the cooling water tube 17 to give its latent heat to the water in the cooling water tube 17 so that the heat is exchanged between the sodium 16 and the water.

The heat exchanger shown in FIGS. 8 and 9 can be small-sized, because the cooling water tube 17 is disposed in the heat pipe 13, and it can avoid the contact and mixing between the sodium 16 and the water. Since, however, the inner wall face of the heat pipe 13 in its entirety acts as the evaporator for the working fluid 12, the baffle plates 15 are indispensable for distributing the working fluid 12 vertically all over the inner wall face of the heat pipe 13. This means that the heat exchanger is troubled by a complex structure, poor productivity, and high production cost.

Incidentally, there is also disclosed in the prior art, as in Japanese Patent KOKAI No. 61-235688, a heat regenerator which uses heat pipes arranged in horizontal positions. In this heat regenerator, an outer tube having its two ends sealed up is mounted on the outer circumference of an intermediate portion of an inner tube, and the sealed chamber defined by the outer circumference of the inner tube and the inner circumference of the outer tube is sealed up with a working fluid, thus constructing each of the thermal diode type heat pipes. These heat pipes are arranged in the horizontal positions and in multiple stages within a regenerative substance, and the individual inner tubes are connected to one another. As a result, in case a heating medium is introduced into the inside of the inner tubes, a heat transfer is established in a higher-temperature layer of the regenerative substance than the heating medium from the regenerative substance to the heating medium by the actions of the heat pipes. In a lower-temperature layer of the regenerative substance than the heating medium, on the other hand, the heat pipes remain inactive, because they are of the thermal diode type, so that no heat exchange is caused between the regenerative substance and the heating medium. This raises no disturbance in the temperature layers formed in the regenerative substance, that the regenerative substance can be prevented from becoming cold. This means that efficient regenerations can be ensured.

According to Japanese Patent KOKAI NO. 61-235688, however, the apparatus disclosed has its heat pipes arranged in the horizontal positions which match the temperature layers formed by the regenerative substance, and accordingly the inner tubes protruding from the heat pipes are also dipped in the regenerative substance. As a result, defects such as pin holes, if any, in the inner tubes will invite a danger that the heating medium flowing in the inner tubes directly contacts and mixes with the regenerative substance. This makes it impossible to convert the apparatus into a heat exchanger to be used for heat exchange between metallic sodium and water, which will react intensely if they contact.

OBJECTS AND SUMMARY OF THE INVENTION

It is, therefore, an object of the present invention to provide a heat pipe type heat exchanger which can ensure an efficient heat exchange without any contact and mixing of higher- and lower-temperature fluids and which is so simple in structure that it can be small-sized.

In the heat exchanger according to the present invention, therefore, heat pipes are arranged horizontally to extend through a container for containing a first heating medium or causing the same to flow therethrough and have their through portions sealed up, and tubes are extended axially through those heat pipes and have their through portions sealed up gas-tight. A second heating medium is introduced into the tube so that the heat exchange may be effected between the two heating mediums through the heat pipes.

Another object of the present invention is to provide the above-specified heat pipe type heat exchanger in which the plural heat pipes extend horizontally through the container and in which the tubes extending axially through the respective heat pipes have their ends protruding from the container and connected in a zigzag shape to one another by means of bends.

According to the heat exchanger of the present invention, therefore, the heat exchange between the first and second heating mediums can be established in the container, and the area for the heat exchange is enlarged so that the heat exchanger can be accordingly small-sized.

In the present invention, therefore, either the first or second heating medium may be metallic sodium, whereas the other heating medium may be water. Even in this case, the heat pipes separate the metallic sodium from the water so that these two mediums can be prevented in advance from directly contacting and intensely reacting.

BRIEF DESCRIPTION OF THE DRAWINGS

Other objects, features and advantages of the present invention will become apparent from the following description taken with reference to the accompanying drawings, in which.

DESCRIPTION OF THE PREFERRED EMBODIMENTS

Figure 1:
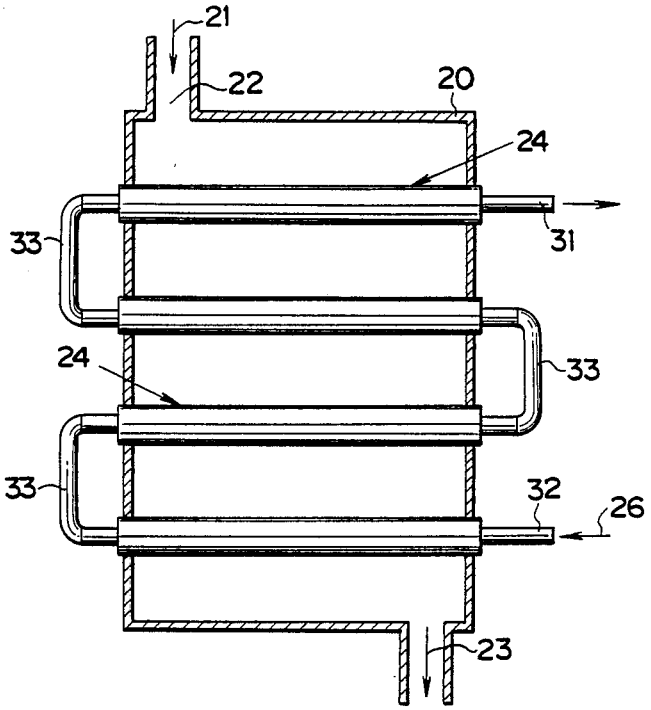
FIG. 1 is a schematic section showing a heat pipe type heat exchanger according to one embodiment of the present invention.
Figure 2:
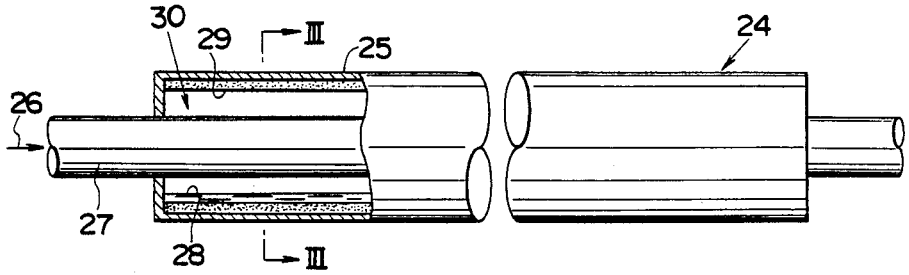
FIG. 2 is a schematic view showing one of the heat pipes of the heat exchanger of FIG. 1 in parallel section.
Figure 3:
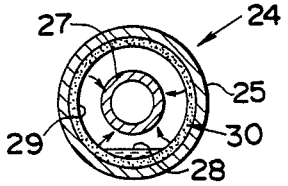
FIG. 3 is a transverse section taken along line III—III of FIG. 2.

As shown in FIG. 1, a container or shell 20 is formed in its opposed walls with an inlet 22 and an outlet 23 so that a higher-temperature fluid (e.g., liquid sodium) 21 to have its heat exchanged may flow therein in one direction. The shell 20 is equipped with a plurality of double pipes 24 which extend horizontally through the right and left walls of the shell 20. As better seen from FIGS. 2 and 3, each double pipe 24 is constructed of: an outer tube 25 having its two ends closed; and an inner tube 27 which extends gas-tight and coaxially through the outer tube 25 while sealing the same so as to provide a passage for a lower-temperature fluid (e.g., water) 26. The inside of the outer tube 25 (namely, the chamber having an annular section between the outer tube 25 and the inner tube 27) is sealed up with a predetermined condensable fluid as its working fluid 28 after it has been evacuated. Moreover, the outer tube 25 is lined with an annular wick 29 which is made of a wire gauze for causing a capillary action. As a result, heat pipes 30 are formed in that annular chamber. As the working fluid 28, incidentally, there can be used a variety of fluids in accordance with a target temperature and the kind of fluid to be heat-exchanged. In case the higher temperature fluid 21 is sodium whereas the lower temperature fluid 26 is water, for example, mercury can be employed as the working fluid.

The double pipes 24 thus constructed are arranged in such generally horizontal positions within the shell 20 as to extend through the right and left walls of the shell 20 and are fixed liquid-tight in those walls by the use of means for welding them from the outside. Of these double pipes 24, the pipe 24 positioned at the side of the inlet 22 has its inner tube 27 providing a cooling water outlet 31 at its one end, whereas the pipe 24 positioned at the side of the outlet 23 has its inner tube 27 providing a cooling water inlet 32 at its one end. Every adjacent pipes 24 have their inner tubes 27 connected at the ends to each other by connecting pipes 33 such as return bends. As a result, the double pipes 24 are formed as a whole into one zigzag or meandering piping.

By the use of the heat exchanger thus constructed, a heat exchange is accomplished between the higher-temperature fluid 21 and the lower-temperature fluid 26. For this operation, the higher-temperature fluid 21 is introduced into the shell 20 from the inlet 22 to the outlet 23, and the lower-temperature fluid 26 is introduced into the meandering piping from the cooling water inlet 32 to the cooling water outlet 31. Since, in this instance, the double pipes 24 are arranged in the horizontal positions, the working fluid 28 in the heat pipes 30 is accumulated in the bottom of the outer tubes 25 by its own weight and is distributed to the whole inner circumference of the outer tubes 25 by the annular wicks 29. As a result, the working fluid 28 is evaporated by the heat, which is given from the higher-temperature fluid 21 in the shell 20 through the walls of the outer tubes 25 (in other words, the working fluid 28 absorbs the heat of the higher-temperature fluid 21 and evaporates), and the resultant steam comes into contact with the inner tubes 27 to have its heat transferred to the lower-temperature fluid 26 flowing in the inner tubes 27 so that it condenses. In short, the working fluid 28 transfers the heat as latent heat radially of the heat pipes 30 to intermediate the heat transfer from the higher-temperature fluid 21 to the lower-temperature fluid 26. Incidentally, the working fluid 28 in a liquid phase, which has condensed on the outer circumferences of the inner tubes 27, drips down by its own weight and is then heated and evaporated again for reuse in the heat transfer.

Figure 4:
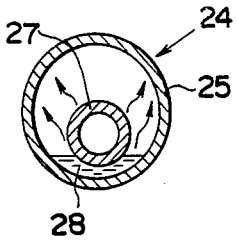
FIGS. 4 and 5 are similar to FIG. 3 but show other embodiments of the heat pipe, respectively.
Figure 5:
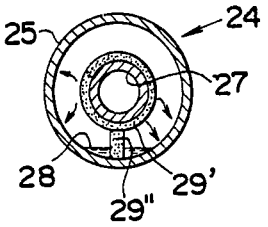
Figure 6:
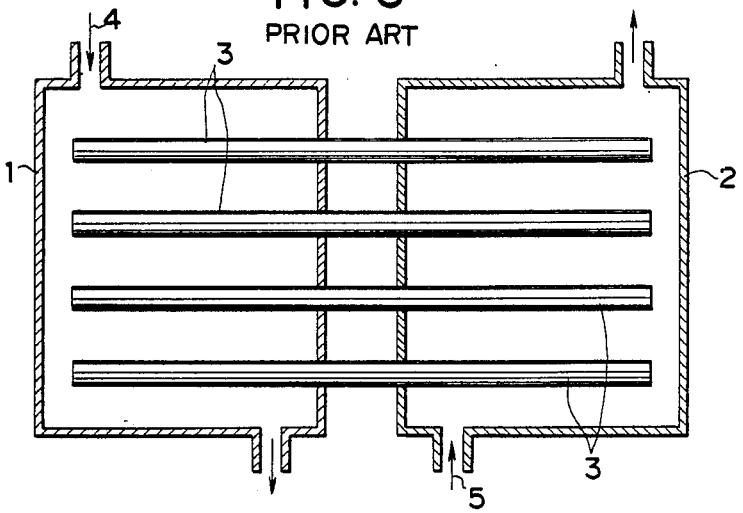
FIG. 6 PRIOR ART
FIG. 6 is a schematic view showing one example of the heat pipe type heat exchanger according to the prior art.
Figure 7:
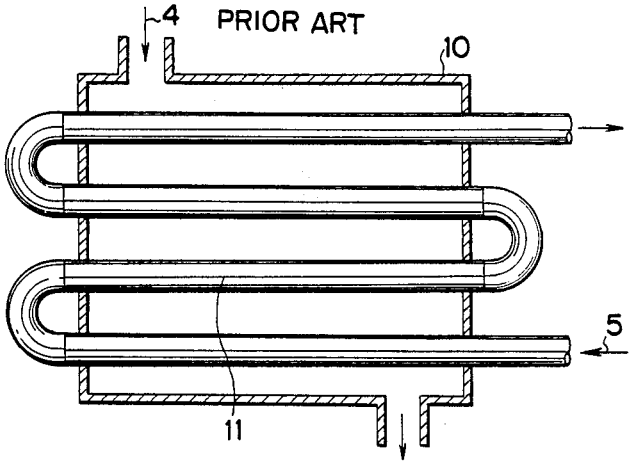
FIG. 7 PRIOR ART
FIG. 7 is similar to FIG. 6 but shows one example of the shell tube type heat exchanger according to the prior art.
Figure 8:
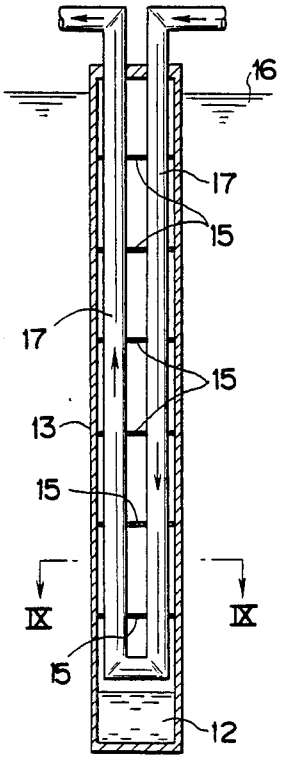
FIG. 8 PRIOR ART
FIG. 8 is a schematic view showing another example of the heat pipe type heat exchanger according to the prior art for the heat exchange between sodium and water.
Figure 9:
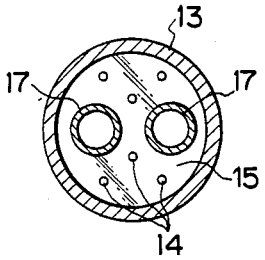
FIG. 9 PRIOR ART
FIG. 9 is an enlarged transverse section taken along line IX—IX of FIG. 8.

In the embodiment thus far described, the higher-temperature fluid 21 flows within the shell 20 so that the inner circumferences of the outer tubes 25 of the heat pipes 30 provide the evaporator. However, the present invention can be modified such that the higher-temperature fluid 21 flows through the inner tubes 27 of the double pipes 24 to cause the outer circumferences of the inner tubes 27 to act as the evaporator. In this modification, each inner tube 27 is offset downward with respect to the corresponding outer tube 25, as shown in FIG. 4, so that it may be partially dipped in the workding fluid 28 in the liquid phase. In an alternative, as shown in FIG. 5, each inner tube 27 may be covered on its outer circumference with an annular wick 29' and equipped with radial work 29'' which extends radially in an upright position from the outer face of the inner tube 27 and the inner face of the outer tube 25 so that the working fluid 28 in the liquid phase may be supplied to the outer circumference of the inner tube 27 acting as the evaporator by those annular and radial wicks 29' and 29''.

As is now apparent from the description thus far made, according to the present invention, tubes are extended axially through heat pipes which are arranged in horizontal positions, and the outer circumferences of the heat pipes and the inner circumferences of the tubes are used as endothermic portions and exothermic portions so that the heat exchanger of the present invention can have its total structure small-sized. In the heat exchanger of the invention, moreover, the heat pipes intermediate the heat exchange between the first and second fluids. Because of the high heat conductivity of the heat pipes, the efficiency of this heat exchange can be substantially equivalent to that to be effected through a single metal wall. In the heat exchanger of the invention, moreover, those portions of the tubes for the second heating medium, which are disposed in the container, are covered with heat pipes so that what occurs is the leakage of the second heating medium into the heat pipes to prevent in advance the second heating medium from directly contacting or mixing with the first one even if the tubes become defective with the pin holes. This similarly applies to the case in which the heat pipes become defective. In this case, too, the first heating medium in the container will leak into the heat pipes at the worst, but the two heating mediums are prevented from contacting or mixing with each other. Such defects can be instantly detected by measuring the pressure in the heat pipes. As a result, the heat exchanger of the present invention can be effectively applied to heat exchange between sodium and water, which are used as the cooling mediums of a nuclear reactor. Since the heat pipes are arranged generally horizontally, furthermore, the distribution of the working fluid in the heat pipes to the evaporator may be exemplified by the natural flow of the working fluid itself or by the use of the ordinary wick. As a result, the structure of the heat pipes can be simplified. In addition, the heat pipes may be fixed to the container from the outside and sealed up, which means that the heat exchanger of the present invention can enjoy an excellent productivity.

What is claimed is:

1. A heat pipe type heat exchanger for use in a nuclear reactor, said heat exchanger comprising:

(a) a container having:
  (i) an upper end and a lower end;
  (ii) an inlet for liquid sodium at said upper end; and
  (iii) an outlet for the liquid sodium at said lower end;

(b) a plurality of tubes extending through said container fluidtightly and with at least substantially horizontal axes, the lowest one of said plurality of tubes having one end connected to an inlet for cooling water, the highest one of said plurality of tubes having one end connected to an outlet for the cooling water, and said plurality of tubes being connected fluidtightly and in zig-zag shape to the adjacent one or ones of said plurality of tubes to form a continuous, fluidtight path;

(c) a plurality of heat pipes, each one of said plurality of heat pipes surrounding a corresponding one of said plurality of tubes coaxially and being spaced therefrom, each one of said plurality of heat pipes protruding outside said container at each end thereof and being closed at each end fluidtightly on the corresponding one of said plurality of tubes outside said container;

(d) a plurality of annular porous wicks, each one of said plurality of annular porous wicks being in continuous circumferential contact with a corresponding one of said plurality of heat pipes over the full axial length thereof and being spaced radially from the corresponding one of said plurality of tubes; and (e) mercury contained in the annular space between each one of said plurality of tubes and the corresponding one of said plurality of annular porous wicks.

2. A heat pipe type heat exchanger according to claim 1 wherein said plurality of heat pipes are welded to said container from the outside of said container.

* * * * *

UNITED STATES PATENT AND TRADEMARK OFFICE

CERTIFICATE OF CORRECTION

PATENT NO. : 4,842,053

DATED : June 27, 1989

INVENTOR(S) : YATSUHASHI, Motoharu, et al

It is certified that error appears in the above-identified patent and that said Letters Patent is hereby corrected as shown below:

On the Title Page, Item [75], the third inventor's name is incorrect, it should read as follows:

--SHINICHI SUGIHARA--

Signed and Sealed this

Eighth Day of May, 1990

*Attest:*

HARRY F. MANBECK, JR.

*Attesting Officer*

*Commissioner of Patents and Trademarks*